United States Patent [19]

Berge

[11] Patent Number: 4,878,328

[45] Date of Patent: Nov. 7, 1989

[54] LOG-CORNERED SIDING FOR BUILDINGS

[76] Inventor: Ronald J. Berge, 11217 NE. Marx Pl., Portland, Oreg. 97220

[21] Appl. No.: 199,867

[22] Filed: May 27, 1988

[51] Int. Cl.[4] ..... E04B 1/10

[52] U.S. Cl. ..... 52/233; 52/284

[58] Field of Search ..... 52/233, 284, 286; 446/106

[56] References Cited

U.S. PATENT DOCUMENTS

| | | | |
|---|---|---|---|
| 1,654,120 | 12/1927 | Ewing | 52/233 |
| 1,996,735 | 4/1935 | King | 52/233 |
| 2,110,787 | 3/1938 | Brandjord | 52/233 |
| 2,309,426 | 1/1943 | Williams | 52/233 |
| 4,096,674 | 6/1978 | Kollar et al. | 52/233 |
| 4,320,610 | 3/1982 | Rupp | 52/233 |
| 4,330,973 | 5/1982 | Marklund et al. | 52/233 |
| 4,592,182 | 6/1986 | Felser | 52/233 |
| 4,627,204 | 12/1986 | Smith | 52/233 |
| 4,640,069 | 2/1987 | Felser | 52/233 |

*Primary Examiner*—Michael Safavi

*Attorney, Agent, or Firm*—Chernoff, Vilhauer, McClung & Stenzel

[57] ABSTRACT

A system of modular siding components and method of installation of such components onto an existing building frame or wall is disclosed. The system comprises a plurality of modular planks and right and left corner assemblies. These components are assembled by resting outwardly directed convex plank faces with respective inwardly directed concave ends of corner assemblies. A right and left corner assembly are alternately installed at successive courses of the corner so as to simulate the appearance of log construction.

1 Claim, 2 Drawing Sheets

LOG-CORNERED SIDING FOR BUILDINGS

BACKGROUND OF THE INVENTION

The present invention is directed to a system of wood siding components and to a method of installation of such siding onto a building structure. More particularly, the invention relates to a system of modular planks and corner assemblies and to a method of installation of such components onto a building frame so as to achieve the appearance of log construction.

The installation of external building siding which simulates the appearance of stacked logs typically employs the connection of extending log end segments alternately to each course of a wall corner, as shown for example in Ewing U.S. Pat. Nos. 1,654,120, Felser, 4,592,182 and Felser 4,640,069. These systems, however, require dual on-site connection of the log-end segments, first, directly to the underlying building structure or transverse plank of an adjoining wall and secondly to a segment of plank extending outwardly from the corner of the wall. Ewing, for example, requires the on-site joining of three members to form each log end segment.

Therefore, a need exists for a system of modular log-cornered siding for buildings which can be economically assembled on-site to form a structurally strong and water-tight corner assembly having the appearance of stacked log construction.

SUMMARY OF THE INVENTION

The present invention eliminates the need for costly on-site assembly of log corner segments required in the course of the installation of log-like siding systems of the prior art.

A preferred embodiment of the siding system comprises a plurality of modular planks and right and left corner assemblies. The planks have a convex outer surface and a planar inner surface with a tongue extending along one longitudinal edge of the plank and a matching groove along the opposite edge. The corner assemblies are comprised of a plank segment integrally joined at one end to a coplanar log segment. Each log segment has an inwardly directed concave end which conforms to the convex outer surface of a plank when the end of the plank is positioned normally against the corner assembly and adjacent to the concave end of the log segment. Thus an overlapping seal is formed between the plank and the log segment. The right and left corner assemblies are each mirror image configurations of each other, with right corner assemblies having plank segments which extend leftwardly of a respective log segment and left corner assemblies having plank segments which extend rightwardly of a respective log segment. These modular components are assembled by nesting the outwardly directed convex face of a plank with a respective inwardly directed concave end of a log segment so as to define a corner having the log segment projecting horizontally beyond the corner. A right and left corner assembly are alternately installed at successive courses of the corner so as to simulate the appearance of log construction.

Accordingly, it is a principal object of the present invention to provide a modular system of log-cornered siding having a minimum number of components.

It is a further object of the present invention to provide a system of construction of log-cornered siding which reduces on-site component assembly.

It is a still further object of the present invention to provide a system of log-cornered siding having structurally strong and water-tight corner assemblies.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
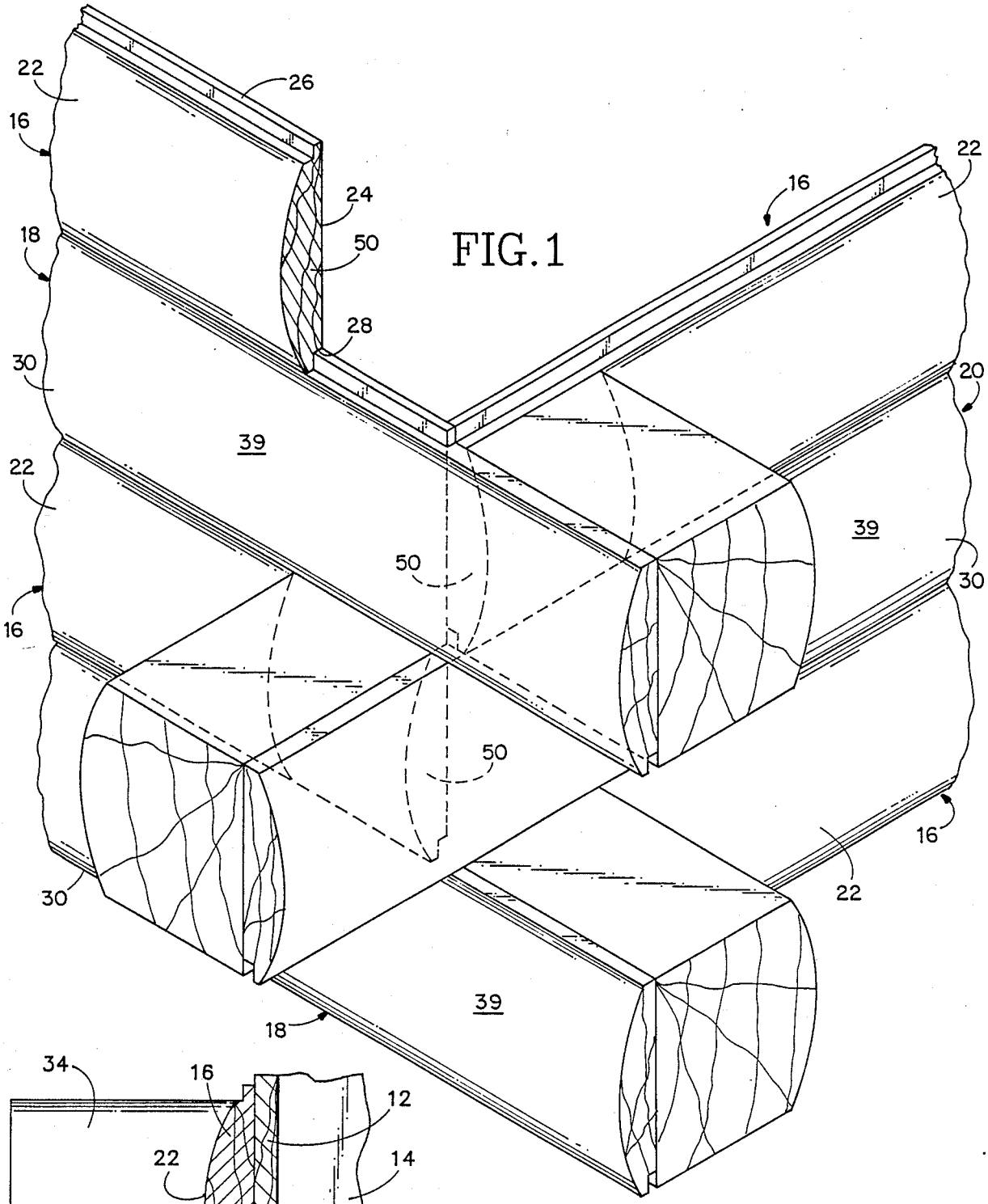
FIG. 1 is a perspective view of the corner portion of an exemplary embodiment of a modular siding system constructed in accordance with the present invention.
Figure 7:
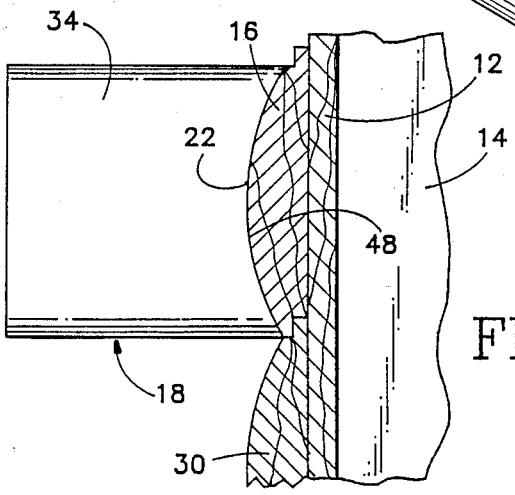
FIG. 7 is a sectional view taken along line 7—7 of FIG. 2.
Figure 2:
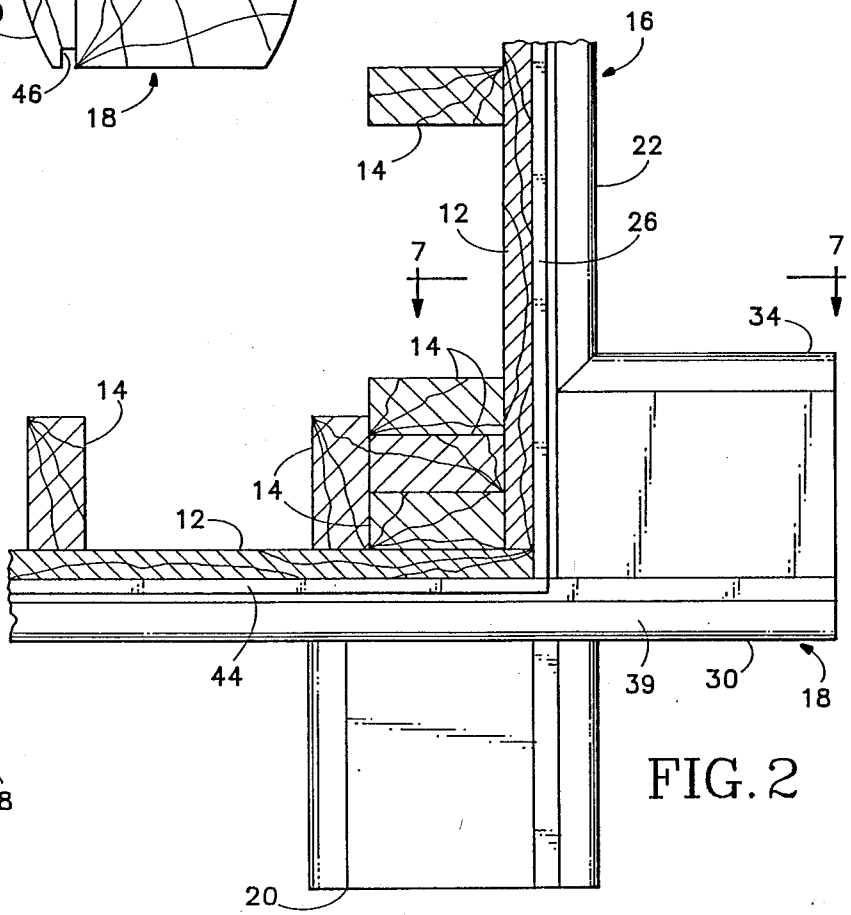
FIG. 2 is a sectional plan view of the siding assembly of FIG. 1.
Figure 4:
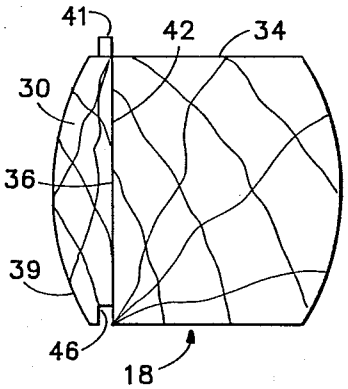
FIG. 4 is an end elevation view of the corner assembly of FIG. 3.
Figure 3:
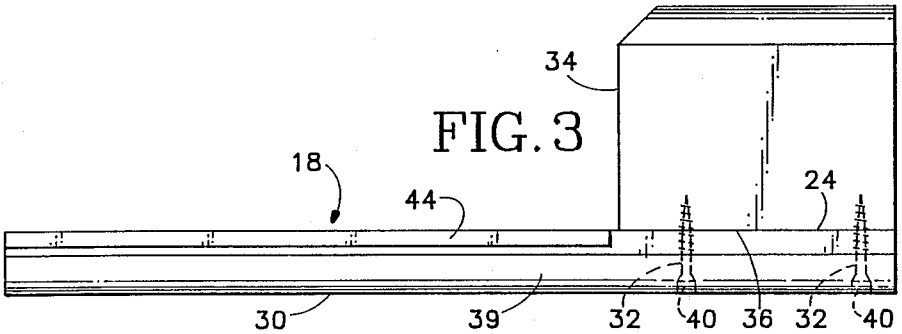
FIG. 3 is a plan view of a right corner assembly of the present invention.
Figure 5:
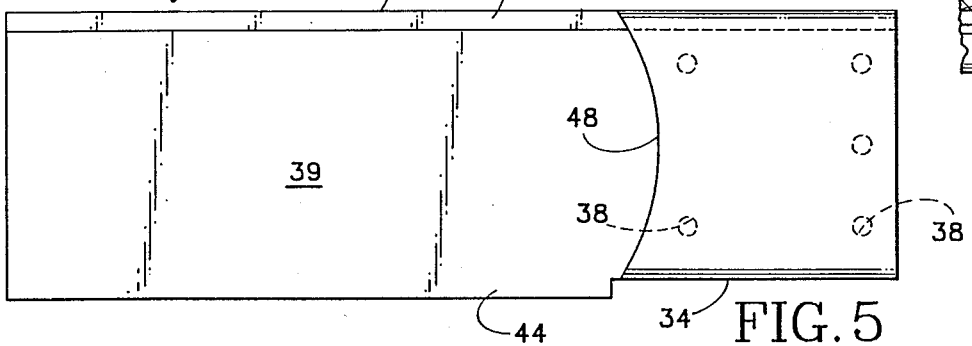
FIG. 5 is a first side elevation view of the corner assembly of FIG. 3.
Figure 6:
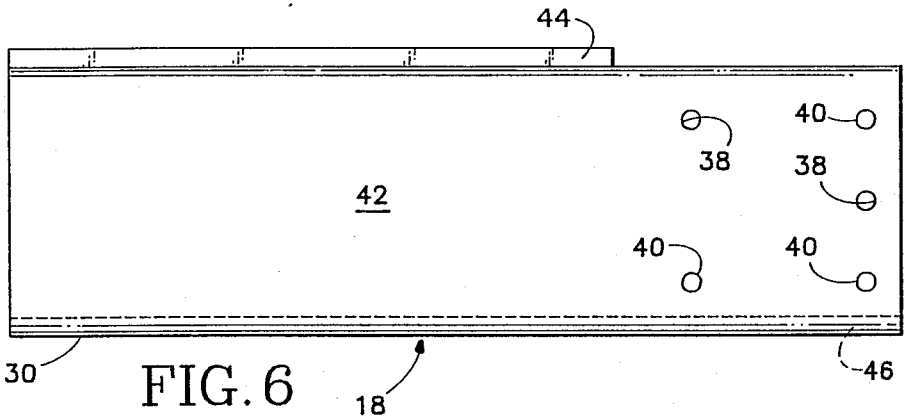
FIG. 6 is a second side elevation view of the corner assembly of FIG. 3.

Referring to the drawings, wherein like numerals refer to the same elements, and in particular to FIGS. 1 and 2, a preferred embodiment of the modular log cornered siding of the present invention is shown installed onto a corner portion of existing building siding 12. In addition, the siding of the present invention can be installed directly onto the studs 14 of a structural frame. The siding comprises a plurality of modular planks 16 and a plurality of right and left corner assemblies 18, 20, respectively. Each plank 16 has a convex outer surface 22 and a planar inner surface 24 and has a tongue 26 extending along the length of its upper longitudinal edge and a matching groove 28 extending along the length of its lower longitudinal edge for receiving the tongue of a plank located on an adjoining lower course. As best seen in FIGS. 3, 4, 5 and 6, a right corner assembly 18 is comprised of a plank segment 30 which is integrally joined along an end portion of its planar inner surface 42, to a respective mating coplanar face 36 of a log segment 34 using wood screws 32 and adhesive. The wood screws 32 are each received in a respective circular recess 38 on the convex outer surface 39 of each plank segment. When fully engaged, the heads of screws 32 are thereby recessed below the outer surface 39 so as to define seats for wooden plugs 40. The plank segments 30 are identical in size and configuration to the modular planks 16, and have an outer convex surface 39, a planar inner surface 42, a tongue 44 and a matching groove 46. However, unlike the tongues 26 of the planks 16, which extend the entire length of the plank 6, the tongues 44 of the plank segments 30 do not extend along the end of the plank segment which is integrally joined to the log segments 34, as can best be seen in FIG. 5. As seen, for example, in FIG. 7, each log segment 34 has an inwardly directed concave end surface 48 which conforms to the convex outer surface 22 of a plank 16 when the plank is positioned normally against the corner assembly and adjacent to the concave end of the log segment 34.

The left corner assemblies 20 are mirror image configurations of the right corner assemblies 18. The right corner assemblies 18, when viewed facing a convex outer surface 39 and with tongue 44 upwardly directed, have plank segments 30 which extend leftwardly of a respective log segment 34. When similarly viewed, left corner assemblies 20 have plank segments 30 which extend rightwardly of a respective log segment. As shown in FIG. 1, the modular components 16, 18, 20 are assembled by nesting the outwardly directed convex face 22 of a plank 16 with a respective inwardly directed concave end 48 of a log segment 34 so as to define a corner having the log segment projecting horizontally beyond the corner. Since the concave end of the log segment overlies the convex face of the plank for a considerable extent, this arrangement provides a rigid waterproof corner joint when the siding is installed using fasteners such as galvanized casing nails onto a conventional stud frame without the necessity of modifying the corners of the frame. In the assembled corner portion of each course, the straight vertical end edge 50 of a plank 16 abuts the planar inner surface 42 of a respective plank segment 30 when nested with a respective log segment. Right and left corner assemblies 18, 20 are alternately installed at successive courses of the corner so as to simulate the appearance of log construction.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A modular wood siding providing the appearance of log construction comprising:

(a) a plurality of planks each having a convex outer surface and a planar inner surface;

(b) a plurality of log segments each having a convex outer surface and a planar inner surface, each of said planks having a first end portion which is integrally joined at the inner surface thereof to the inner surface of a respective one of said log segments, and a second end portion which is not joined to one of said log segments;

(c) each log segment having an inwardly directed concave end which conforms to the convex outer surface of said planks so as to define a corner having a log segment projecting therefrom when the second end portion of one of said planks is positioned normally against the first end portion of another one of said planks adjacent to the concave end of the log segment affixed thereto; and (d) the second end portion of said planks include ends having straight vertical edges which abut the planar inner surface of the plank they are positioned normally against.

* * * * *